United States Patent [19]

Sheets

[11] Patent Number: 4,753,091

[45] Date of Patent: Jun. 28, 1988

[54] PIVOTING TUMBLER SYSTEM

[76] Inventor: Timothy Sheets, 34800 S. Hwy. 1, Gualala, Calif. 95445

[21] Appl. No.: 48,411

[22] Filed: May 11, 1987

[51] Int. Cl.[4] ..... E05B 27/04

[52] U.S. Cl. ..... 70/364 A; 70/419; 70/421

[58] Field of Search ..... 70/421, 419, 365, 366, 70/364 A, 358

[56] References Cited

U.S. PATENT DOCUMENTS

| | | | |
|---|---|---|---|
| 588,196 | 8/1897 | Taylor | 70/421 |
| 3,418,833 | 12/1968 | Kerr | 70/421 |
| 3,585,826 | 6/1971 | Mercurio | 70/366 |
| 4,377,082 | 11/1980 | Wolter | 70/364 A |
| 4,638,651 | 1/1987 | Surko | 70/419 |

FOREIGN PATENT DOCUMENTS

| | | | |
|---|---|---|---|
| 2280772 | 2/1976 | France | 70/421 |

*Primary Examiner*—Robert L. Wolfe

*Attorney, Agent, or Firm*—Christie, Parker & Hale

[57] ABSTRACT

Pivotable tumblers mounted to a cylindrical plug prevent rotation of the plug unless a correct key in a keyway moves the tumblers to an unlocked position. If the tumblers extend too far into the keyway, pawls mounted in the body and acting on steps of the plug prevent rotation of the plug to an unlocked position. If the tumblers do not extend for enough into the keyway, the tumblers jam up against a reentrant shoulder of the body preventing the plug from reaching the unlocked position. A security keyway closure or door cams off a race in the body and closes the keyway with rotation of the plug. A slot in the key passes the door during operation.

18 Claims, 3 Drawing Sheets

PIVOTING TUMBLER SYSTEM

BACKGROUND OF THE INVENTION

The present invention relates to key-actuated locks in general, and more in particular, to key-actuated locks of the type that use a rotatable plug cylinder in a body and tumblers that interfere with rotation of the cylinder to effect a lock.

Key-actuated locks use a plug cylinder rotatable in a body and movable tumblers that interfere with rotation of the cylinder with respect to the body and, consequently, the actuation of some opening device, such as a latch or bolt. Bits of the key actuate the tumblers to permit unlocking. The bits displace the tumblers radially with respect to the axis of rotation of the cylinder. With the right key, the tumblers move out of the rotational path of the cylinder and permit rotation of the cylinder and the unlocking of the lock. Springs bias the tumblers into a locking position interfering with rotation of the cylinder. In greater detail, the tumblers have followers that engage the key bits and engage pins of the tumblers. When the boundaries of all of the pins and followers line up on the diameter of the cylinder, the cylinder can turn with respect to the body. The bits line the boundaries up. Lost motion and various other techniques may determine when, during rotation of the cylinder, the tumblers can prevent unlocking, but the general operation of the cylinder, tumblers, and body is as described.

Locks of this type are not immune from picking. In an effort to make picking more difficult, the displacement of the tumblers can be made to depend not only on the radial distance of the bits of a key from the axis of rotation of the cylinder plug, but also on the angle of the bit faces with respect to radial planes that pass at right angles through the axis of rotation; U.S. Pat. Nos. 3,499,302 and 3,499,303 illustrate this technique.

To make it harder to drill out locks and open them that way, locks have drill shields and gates within the lock that block access to portions of the lock sensitive to being drilled.

SUMMARY OF THE INVENTION

The present invention provides a new cylinder lock that uses pivoting tumblers that prevent rotation of a key plug with respect to a body, unless tumblers pivot into position to clear the interface between the key plug and body. A key with proper bit orientation displaces fingers of the tumblers to pivot the tumblers slightly so that the tumblers, during rotation of the key plug, keep pawls from engaging the key plug and stopping rotation. If the bits do not register properly with the fingers of the tumblers, either the key pivots the tumblers further toward the body and into a cavity of the body, or does not pivot the tumblers sufficiently. In the former, after some rotation of the plug, the tumblers wedge up against a reentrant surface of the cavity and block further rotation of the plug with respect to the cylinder so that the lock does not unlock. In the latter, pawls engage the plug and keep it from rotating. Preferably, dead-end holes in the key may act as bits and determine whether and how far the tumblers pivot toward the keyway and whether the plug turns in the body. When the keyholes are too deep, the fingers of the tumblers pivot in response to the force of the pawl well into the keyway, exposing the key plug to engagement by the pawls to prevent further turning of the plug. When the holes in the key are too shallow, the tumblers intrude into the cavity and jam against the cavity surface; when the holes are just right, the tumblers do not present the plug for engagement by the pawls, nor do the pawls jam up against the reentrant cavity surface, and the plug turns to unlock the lock. Instead of holes to determine the position of the tumblers, the rotational position can be determined by stops on the fingers that engage surfaces of the key, among other techniques.

To prevent picking the tumblers, a door at the entrance to the keyway and mounted to the plug closes the keyway when the plug rotates by a race in the body engaging the door. A hole in the key accepts the door when the plug rotates and forces the door into the keyway. The door in the keyway prevents access of the picking tools to the tumblers at rotational positions of the key plug where the race keeps the door closed.

In a detailed form, the present invention contemplates a key plug mounted for rotation in a body. The plug carries a plurality of pivotal tumblers. Each tumbler has a shank and an inwardly-directed lug or finger. Slots in the plug accept the fingers so that the fingers can move into the keyway and out of it. The shanks have outer radial surfaces that extend circumferentially with respect to the rotational axis of the plug for several degrees of arc, say, about 60°. Pawls biased radially inward mount in the body and normally intrude into a cavity that faces the tumbler shanks and engage the shanks between a 0° rotation position of the plug, a position corresponding to a key insert position, and some advanced intermediate rotational position, say, 60°. During rotation of the plug between these two positions, the shanks and pawls engage, the shank being biased outward, and the pawls being biased inward. The bias force acting through the pawls on the tumblers overcomes the outward bias force on the tumblers after a predetermined amount of rotation of the plug to force the tumblers to pivot and the fingers to enter the keyway and enter the bits in the key. If the bits are not there, the key prevents the tumblers from pivoting all the way, and the radial surfaces of the tumblers jam up against a reentrant surface or step in the cavity, preventing further rotation of the plug. When the bits in the key are too deep, the pawls force an extreme pivot of the tumblers so that the tumblers clear a step of the plug that, in turn, engages the pawls to prevent further rotation. When the key bits are just right, the tumblers cover the shoulders, and the shoulders rotate past the pawls so that the plug can rotate to its unlocked lock.

In a detailed form, the keyway blocking door mounts on the key plug in a door slot. A spring between the door and the plug biases the door radially outward away from the rotational axis of the plug. A raceway in the body accepts the door in a 0° rotation position, key insert position, of the plug so that a key can enter the keyway. Upon rotation of the plug, a raceway forces the door radially inward through a slot or passageway in the key.

The lock of this invention can also use linear-acting tumblers to increase the number of permutations and combinations of the tumblers and the security of the lock.

These and other features, aspects, and advantages of the present invention will become more apparent from the following description, appended claims, and drawings.

DESCRIPTION OF THE PREFERRED EMBODIMENTS

Figure 1:
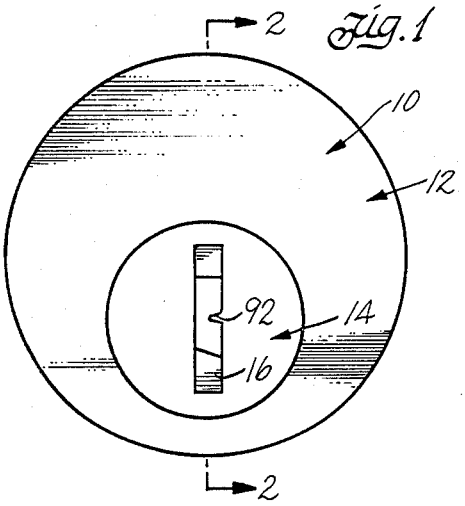
FIG. 1 shows the preferred embodiment of the lock of the present invention in front elevation.
Figure 5:
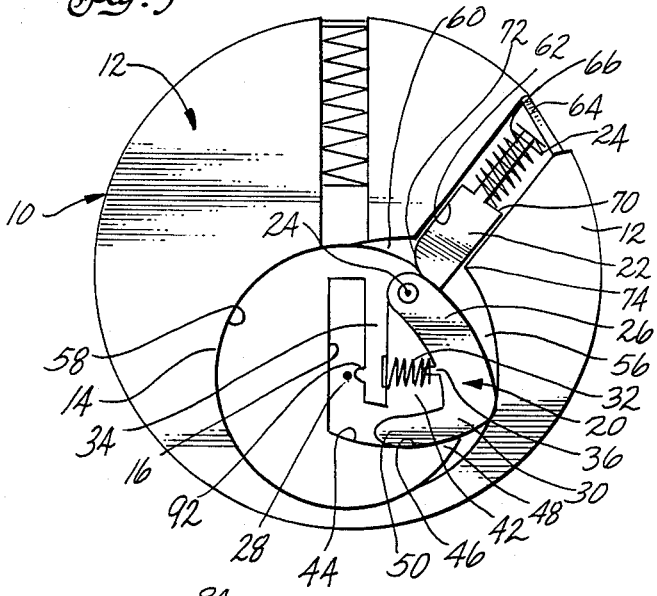
FIG. 5 shows a tumbler and pawl relationship at 0° rotation of the plug with respect to the body.
Figure 6:
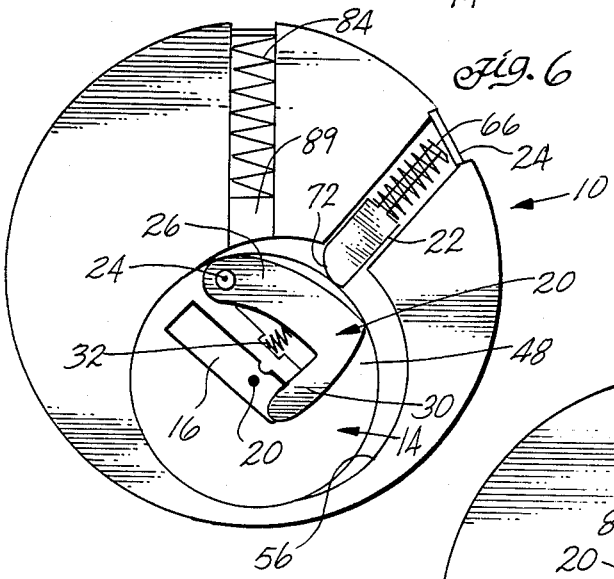
FIG. 6 shows the relationship of a tumbler and pawl after a predetermined amount of rotation of the plug in the body with the pawl forcing a finger of the tumbler into a keyway of the plug and with the pawl engaged in a shoulder of the plug to prevent further rotation of the plug.
Figure 7:
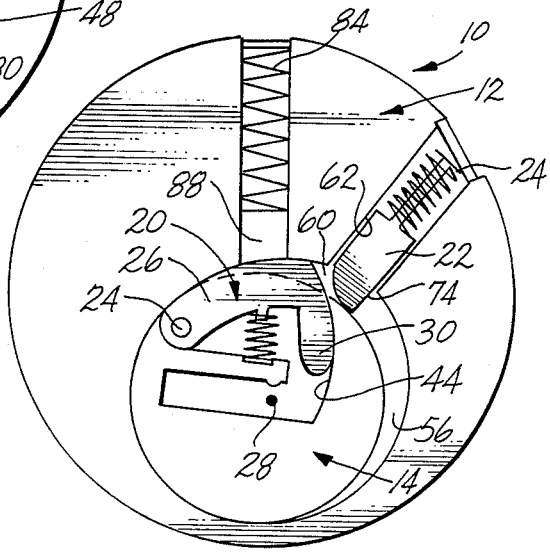
FIG. 7 at a few degrees of rotation of the plug past the position in FIG. 6 with the pawl wedged up against a reentrant surface of the body to prevent further rotation of the plug.

FIG. 1 illustrates a lock 10 that has a generally cylindrical body 12 that receives a plug 14. The plug has a keyway 16. With a proper key in the keyway, the lock operates by turning the plug counterclockwise in FIG. 1 to rotate a standard latch lever or actuating bar shown at 18 in FIG. 2. (The latch lever or actuating bar cooperates with plug 14 in a standard manner and will not be described, except incidentally, because of that.) The lock has a plurality of pivotable, sickle-shaped tumblers, say, four. FIGS. 5–7 show one of those tumblers at 20. Each tumbler 20 cooperates with a pawl 22 mounted in body 12 and biased by a spring 32 acting between the body and the pawl toward plug 14. A pivot pin 24 mounts sickle-shaped tumbler 20 for pivotal movement on plug 14. Tumbler 20 has a shank 26 extending away from pivot 24 circumferentially with respect to a radius of plug 14 from its axis of rotation 28. A finger 30 of the tumbler extends inwardly from shank 26 to interdict keyway 16.

A compression spring 32 acts between a land 34 of plug 14 and shank 26 of tumbler 20 and biases the tumbler counterclockwise in FIG. 5. A keeper 36 on shank 26 anchors the spring at its shank end, and a recess 40 in land 34 anchors the spring on its interior end.

A slot 42 in the plug receives the tumbler. A passageway 44 in the plug between the keyway and slot 42 accepts finger 30.

An arc-shaped surface 46 of slot 42 remote from pivot 24 has a circular curvature and a center of curvature on the pivot. A surface 48, in the form of a step curved in the arc of a circle with a center of curvature at pivot 24, mates with surface 46.

The plug adjacent surface 46 and proximate the outer radial surface of the plug presents a step 48 that engages pawl 22 in one operational mode of this invention.

A tip 50 on finger 30 registers with a hole 52 of a key 54 (the hole and key being shown in FIG. 13) in one operational mode of the present invention.

A cavity 56 in the body opens into a cylindrical bore 58 that receives plug 14. Cavity 56 has radial surface boundaries larger than the radius of bore 58. A reentrant shoulder or surface 60 bounding the cavity at its top end can engage shank 26 of tumbler 20 to prevent rotation of the plug with respect to the body past the point of engagement.

A radial hole 62 in body 12 receives pawl 22. A cover 64 caps hole 62 and provides purchase for spring 32 on the body. A stem 66 of pawl 22 receives the spring to maintain its orientation. The spring purchases on pawl 22 on an interior shoulder 70. A radius 72 at the free, interior corner of the pawl permits tumbler 20 to retract from cavity 56 upon clockwise rotation of plug 14 back towards its 0° of rotation position. A sharp shoulder 74 of the pawl enables the pawl to stay engaged with surface 48 and not cam away from it.

Figure 2:
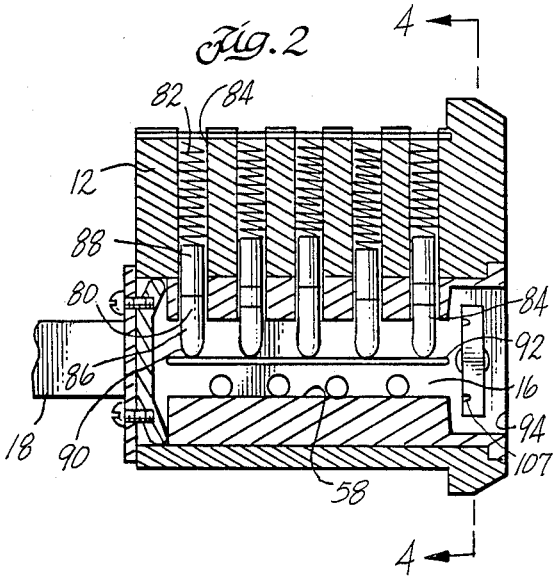
FIG. 2 shows the lock of FIG. 1 in elevational half-section in the plane of 2—2 of FIG. 1.
Figure 3:
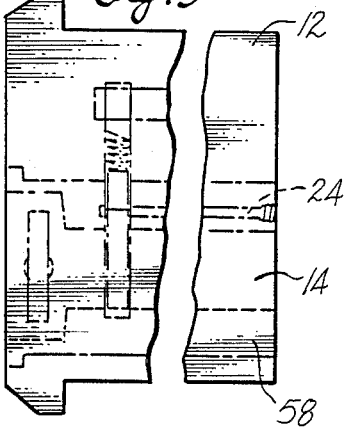
FIG. 3 shows the lock in side elevation with some of the mechanisms in phantom.
Figure 11:
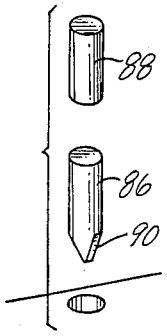
FIG. 11 is an expanded view of a linearly-acting tumbler of the present invention.
Figure 12:
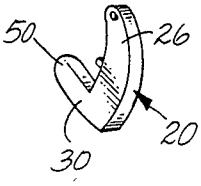
FIG. 12 is a perspective view of a pivoting tumbler of the present invention.

The pivoting tumblers just described cooperates with linearly-movable tumblers shown in FIGS. 2 and 11. Tumblers 80 move radially inward and outward in response to bit positions of a key and the force of compression springs 82. A radial hole in body 12 for each of the tumblers accepts an associated spring 82 and an associated lineal tumbler 80.

Each linear tumbler includes a follower 86 and a pin 88. The pin rides on the follower. A shear line separates the pin from the follower so that when the shear lines of all the linear tumblers register with the outside diameter of the plug and the inside diameter of bore 58, the plug rotates with respect to the body, if permitted to do so by the pivotable tumblers. Each follower 86 has a rounded end 90 that rides in the bites of the key. A ridge or flange 92 extends radially inward from the wall of cylindrical bore 58 and abuts the round T.S. points and keeps springs 82 from forcing the linear tumblers out of holes 84.

The linear tumblers augment the pivotable tumblers in increasing the number of combinations and permutations of tumbler positions and the security of the lock against unauthorized opening.

Figure 4:
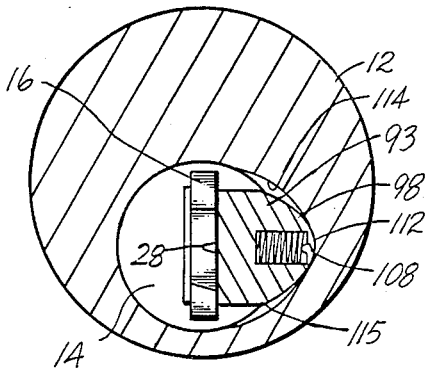
FIG. 4 shows the lock in a front sectional view in the plane 4—4 of FIG. 2.

As seen in FIG. 4, the present invention provides a keyway blocking door 93 that blocks access to the tumblers after the plug rotates a few degrees with respect to the body. (This rotation can be seen in FIGS. 5–7.) Without regard to the presence of the door, to successfully pick the pivotal tumblers, it is necessary to rotate the plug to get the tumblers bearing against the wall of bore 58 at past pawl 22 about the position shown in FIG. 7. To get past the position shown in FIG. 6, one rotates the plug in the body while preventing the fingers of the pawls from moving all the way into keyway 16 until shanks 26 clear shoulders 74 of pawls 22.

Figure 10:
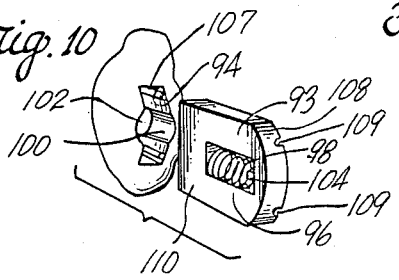
FIG. 10 is a fragmentary perspective view of the sliding door and sliding door slot in the plug.

The door prevents this access. As seen in FIGS. 4 and 10, the door includes a sliding door proper 93. This door tracks in a sliding door slot 94 in plug 14. A slot 96 in the door receives a spring 98. A cylindrical bore 100 of sliding door slot 94 receives the spring. A boss 102 at the interior end of the bore and of the plug urges against spring 98 to bias it radially outward with respect to the rotational axis of the plug. An outer radial end 104 of slot 96 bears on spring 98 so that the spring biases the sliding door radially outward. A keeper 106 keeps the spring in the slot. Spaced apart and parallel guide rails 107 track in parallel slots 109. Door 93 has a rounded nose 108 and a rectangular interior end 110. Nose 108 has a tip 112 that tracks on a race 114 of body 12 that bounds a cavity 115.

In a relaxed position corresponding to 0° of plug rotation, the key insert position, the door is withdrawn from keyway 16, as shown in FIG. 4. This position corresponds to a position where tip 112 bears against the most remote portion of race 114 from axis of rotation 28 of the plug. In this position, keyway 16 can accept a key. The security provided by the door can be augmented by shields that frustrate drilling.

Figure 13:
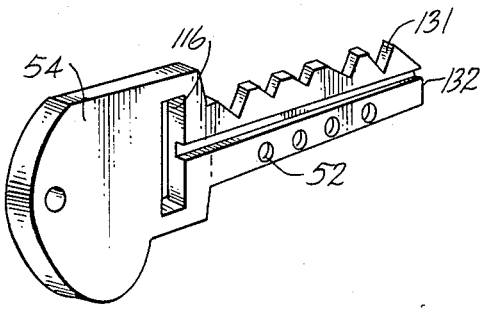
FIG. 13 is a perspective view of a key of the present invention.

With a brief reference to FIG. 13, key 54 has a rectangular slot 116 that passes door 92 during rotation of plug 14. The door closes the keyway when plug 14 rotates with respect to body 12 counterclockwise because tip 112 rides on race 114 where it gets closer and closer to axis 28. Rotation of plug 14 without key 54 also closes the keyway with door 92.

Figure 8:
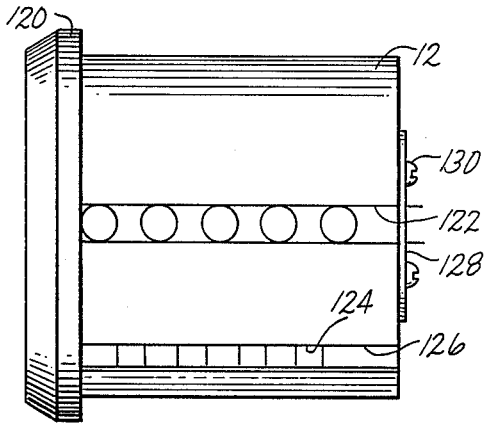
FIG. 8 is a side elevational view of the lock.
Figure 9:
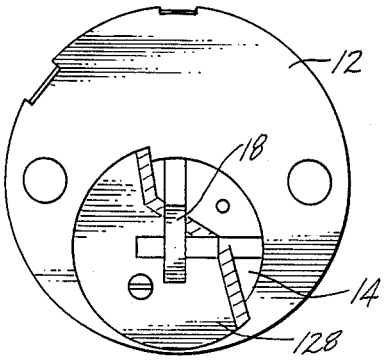
FIG. 9 is a rear elevational view of the body and plug of the lock.

With reference to FIG. 8, the exterior of body 12 shows a standard mounting flange 120 of the body that presents an interior shoulder for abutting against a door. Holes 84 for the linear-acting tumblers extend inwardly from a cover plate receiving slot 122. Windows 124 for radial hole 62 for pawls 22 open into a cover plate slot 126 for cover plate 64. A bore cover plate 128 attaches to the back of body 12 as by screws 130.

With reference again to FIG. 13, key 54 has bits 131 for the linear displacement of tumblers 80. An axially extending slot 132 accepts flange 92 and permits key 54 to enter keyway 16.

In operation, a person inserts key 54 into keyway 16. Bits 131 displace linearly-acting tumblers 80 so that the shear planes of these tumblers line up at the interface between the plug and the body in a standard manner to permit rotation of the plug in the body. The person rotates the key counterclockwise. The linear tumbler cannot interfere with rotation because they are out of their holes.

Holes 52 in the key, acting as bits, accept tips 50 of the pivotal tumblers. If the depths of holes 52 are correct, then the pivotal tumblers will bottom on the key so that shanks 26 of the tumblers do not expose surface 46. With rotation of the plug, pawls 22 bear on the circumferential outside surface of shanks 26 and tend to force the shanks against the key. As the pawls ride along the surfaces of the shanks, they will eventually clear surface 46 and bear against the outside, cylindrical surface of the plug, and the pivotable tumblers will have cleared the pawls. With the correct key, the tumbler shanks mask step 46 and prevent the pawl from engaging the plug and stopping its rotation. With the right key, tips 50 of the tumblers will be sufficiently far within keyway 16 that the reentrant shoulder or surface 60 of cavity 56 will force the tumblers to pivot on pivot pin 24 so that shanks 26 eventually ride on the wall of bore 58, and the plug rotates onto its unlocked position, actuating latch lever or bar 18. The key cannot be withdrawn until the keyway rotates back to its 0° position so that the pivotal tumblers displace into cavity 56 because of the force of springs 32.

With the wrong key in keyway 16, the depths of one or more of holes 62 could be insufficient to completely receive tips 50 of fingers 30 of pivotal tumblers 20. Consequently, the key will force one or more of the tumblers radially outward and into cavity 56 so that one or more of shanks 26 jam up tightly against reentrant surface 60 to prevent rotation of plug 14 thereafter.

With the wrong key, tips 50 of fingers 30 of pivotal tumblers 20 could extend too far into keyway 16 so that one or more shoulders 74 of pawls 22 pass radially inward of the outside surface of plug 14 and into slot 42 ahead of surface or step 46 to engage the plug and prevent its further clockwise rotation.

Alternatively, instead of holes 52, the key can have slots with different angular orientations in the plane of the key. The tumbler tips with a correct key, in such a case, would have tabs with angular orientations to match the slots. If the tips register in the slots, the tumblers can clear cavity 56, and the lock can open.

The present invention has been described with reference to a preferred embodiment. The spirit and scope of the appended claims should not, however, necessarily be limited to this description.

I claim:

1. An improved lock comprising:

a body having a cylindrical bore;

a cylindrical key plug mounted in the body in the cylindrical bore for rotation between a key insert position and an unlocked position;

a keyway in the cylinder;

at least one tumbler pivotally mounted to the cylinder and having a finger spaced from the pivot such that, in a first pivotal position of the tumbler with;

respect to the cylinder the finger interdicts the keyway, and in a second pivotal position of the tumbler with respect to the cylinder rotationally displaced from the first pivotal position the finger is out of the keyway;

finger-biasing means biasing the finger away from the keyway and out of the first pivotal position toward the second position;

a cavity in the body contiguous with the tumbler and opening into the cylindrical bore, the cavity having a reentrant surface disposed to engage the tumbler in its second pivotal position after rotation of the plug from 21 the key insert position towards the lock position and with such engagement and continued rotation of the plug to pivot the tumbler toward the first pivotal position, the finger pivoting into the keyway with such rotation upon registration with a finger-receiving it in a key in the keyway, the key in the absence of such a bit preventing the finger from pivoting into the keyway and maintaining the tumbler in its second pivotal position in engagement with the reentrant surface to prevent further rotation of the cylinder towards the unlocked position; and a pawl means mounted in the body to extend into the cavity and engage the plug and prevent rotation of the plug to the unlocked position when the finger extends too far into the keyway in response to the absence of the constraint of a key.

2. The improved lock claimed in claim 1 wherein the plug has a recess in receipt of the tumbler and a step along a boundary of the recess, the pawl means engaging the plug at the step.

3. The improved lock claimed in claim 1 wherein the tumbler is sickle-shaped and has a shank extending generally circumferentially with respect to the axis of rotation of the plug from the pivot, the finger extending inwardly in the direction of the axis of rotation of the plug from an end of the shank remote from the pivot.

4. The improved lock claimed in claim 3 wherein the pawl means includes pawl-biasing means and a pawl, the pawl-biasing means biasing the pawl towards the plug.

5. The improved lock claimed in claim 4 wherein the finger-biasing means acts on the shank away from the pivot and the pawl along a portion of the rotational path of the plug between the key insert position and the unlocked position engages the shank in opposition to the finger-biasing means, the moment on the tumbler by the finger-biasing means exceeding the moment on the tumbler by the pawl when the shank is proximate the reentrant surface so that the tumbler pivots into its second pivotal position and engages the reentrant surface.

6. The improved lock claimed in claim 5 including at least one linear-acting tumbler means in the body to prevent rotation of the plug unless displaced by a mating bit of a key to an unlocked position.

7. The improvement claimed in claim 5 including door means to close the keyway upon rotation of the plug from the key insert position.

8. The improvement claimed in claim 7 including a key having bits operable to control the position of the tumblers so that the plug can be rotated to its unlocked position, they key having a passageway to accept the door means.

9. The improvement claimed in claim 7 wherein the door means includes a door mounted on the plug to move into and out of the keyway, door-biasing means biasing the door out of the keyway, and a race in the body engaged by the door, and having a progressively smaller radius from the axis of rotation of the plug with angular displacement from the key insert position to the unlocked position.

10. In a cylinder lock of the type having a body with a cylindrical bore and a key plug rotatably mounted to the body in the cylindrical bore for rotation between a key insert position and an unlocked position, the key plug having a keyway, an improvement comprising:

(a) at least one tumbler pivotally mounted to the plug and having a finger extending into the keyway for actuation by the bit of a key, the tumbler having a first pivotal position completely within the bore and a second pivotal position extending from the bore;

(b) a cavity in the body contiguous with the tumbler and having a reentrant surface in the rotational path of the tumble when the tumbler is in the second pivotal position;

(c) means applying a first moment to the tumbler that urges the tumbler to pivot toward the cavity;

(d) means applying a second moment to the tumbler that urges the tumbler to pivot away from the cavity, the second moment application means including a pawl in the body and bias means biasing the pawl into engagement with the tumbler;

(e) means for altering the net moment on the tumbler as the plug rotates from the key insert position toward the unlocked position so that the first moment means pivots the tumbler to the second pivotal position after a predetermined amount of rotation of the key plug in the cylinder from the key insert position to the unlocked position.

11. The improvement claimed in claim 10 including means for the pawl to stop rotation of the plug unless the tumbler is in an unlocked pivotal position and after a predetermined amount of rotation of the plug from the key insert position.

12. The improvement claimed in claim 11 including a keyway-blocking door and means to close the keyway with the door upon rotation of the plug from the key insert position.

13. In a cylinder lock of the type having a body with a cylindrical bore, a cylindrical key plug mounted in the bore for rotation about an axis of rotation between a 0° rotation position and an unlocked position, a keyway in the plug for accepting a key, and tumbler means preventing the plug from rotating to the unlocked position unless key bits of a correct key in the keyway position the tumbler means to permit rotation of the plug, an improvement comprising:

(a) in the tumbler means a pivotable tumbler having a shank pivotally mounted to the plug and extending circumferentially with respect to the axis of rotation of the plug and a finger extending toward the keyway from the shank and spaced from the axis of rotation, the pivotable tumbler having a first pivotal position with the finger interdicting the keyway, a second pivotal position angularly spaced from the first pivotal position with the finger interdicting the first pivotal position, and a third pivotal position angularly spaced from the second position with the finger interdicting the keyway, but not as much as in the second pivotal position, the shank extending outwardly beyond the diameter of the plug in the third pivotal position;

(b) biasing means biasing the pivotal tumbler shank outwardly from the axis of rotation;

(c) a cavity in the body facing the shank and having a reentrant surface, the shank engaging the reentrant surface in the third pivotal position, when acted upon by an object in the keyway, that forces the pivotal tumbler into the third pivotal position, and upon a predetermined amount of rotation of the plug from the 0° position toward the unlocked position; and (d) a pawl means preventing rotation of the plug when the pivotable tumbler is in the first pivotal position, the pawl means including a pawl mounted in the body for travel towards and away from the plug in engagement with the shank of the pivotable tumbler and spring means biasing the pawl toward the plug, the plug having a step adjacent the end of the shank remote from the pivot, the shank masking the step from the pawl except in the first pivotal position, and in that position the pawl engaging the step at a predetermined rotational displacement of the plug from the 0° rotation position.

14. The improvement claimed in claim 13 including keyway door means for closing the keyway upon rotation of the plug from the 0° rotation position.

15. The improvement claimed in claim 13 wherein the keyway door closing means includes a door, a door slot in the plug, the door being slidably mounted in the slot, the door-biasing means biasing the door away from the keyway, and a race in the body and engaged by the door, the race having a profile that forces the door to close the keyway upon rotation of the plug from the 0° rotation position.

16. The improvement claimed in claim 13 including keyway door means for closing the keyway upon rotation of the plug from the 0° rotation position, the keyway door closing means including a sliding door, a door slot in the plug in receipt of the door, door-biasing means biasing the door away from the keyway, and a race in the body and engaged by the door, the race having a profile that forces the door to close the keyway upon rotation of the plug from the 0° rotation position.

17. The improvement claimed in claim 16 including the key for the lock, the key having a slot for passing the sliding door.

18. The improvement claimed in claim 16 including linearly-acting tumbler means supplementing the pivotable tumbler for preventing rotation of the plug into the unlocked position unless a correct key is used.

* * * * *